United States Patent [19]

Ito et al.

[11] 4,281,225

[45] Jul. 28, 1981

[54] PICKUP CARTRIDGE FOR REPRODUCING SIGNALS RECORDED ON A 45-45 STEREOPHONIC RECORD DISK

[75] Inventors: Tsugio Ito; Kenshiro Aizawa; Hisashi Okada, all of Hamamatsu, Japan

[73] Assignee: Nippon Gakki Seizo Kabushiki Kaisha, Hamamatsu, Japan

[21] Appl. No.: 1,826

[22] Filed: Jan. 8, 1979

[30] Foreign Application Priority Data

| | | | |
|---|---|---|---|
| Jan. 17, 1978 | [JP] | Japan | 53-3634[U] |
| Apr. 24, 1978 | [JP] | Japan | 53-54518[U] |
| Oct. 3, 1978 | [JP] | Japan | 53-135702[U] |
| Oct. 3, 1978 | [JP] | Japan | 53-135703[U] |
| Oct. 3, 1978 | [JP] | Japan | 53-135704[U] |

[51] Int. Cl.[3] ..... H04R 9/16

[52] U.S. Cl. ..... 369/139; 369/147

[58] Field of Search ..... 179/100.41 D, 100.41 K, 179/100.41 Z; 274/37

[56] References Cited

U.S. PATENT DOCUMENTS

| | | | |
|---|---|---|---|
| 2,034,872 | 2/1936 | Keller | 179/100.41 D |
| 3,060,281 | 10/1962 | Snepvangers | 179/100.41 K |
| 3,360,616 | 12/1967 | Shiga et al. | 179/100.41 D |
| 3,618,124 | 11/1971 | Dreisbach | 179/100.41 D |

FOREIGN PATENT DOCUMENTS

| | | | |
|---|---|---|---|
| 75642 | 3/1953 | Denmark | 179/100.41 Z |
| 79385 | 6/1955 | Denmark | 179/100.41 Z |
| 292827 | 6/1916 | Fed. Rep. of Germany | 179/100.41 D |
| 1135675 | 8/1962 | Fed. Rep. of Germany | 179/100.41 K |
| 1447982 | 12/1968 | Fed. Rep. of Germany | 179/100.41 K |
| 2727842 | 12/1977 | Fed. Rep. of Germany | 179/100.41 K |
| 810106 | 3/1959 | United Kingdom | 179/100.41 K |

*Primary Examiner*—Bernard Konick
*Assistant Examiner*—Donald McElheny, Jr.
*Attorney, Agent, or Firm*—Cushman, Darby & Cushman

[57] ABSTRACT

A moving coil type pickup cartridge comprises at least two movement-electromagnetism conversion systems functioning in push-pull mode, each system being arranged by a coil supported on a plate and inserted in an air gap between two opposing magnet blocks each constituted by side-to-side two magnets so as to provide opposite magnetic poles facing each other with the air gap intervening therebetween. A linear movement of the coil is allowed in the air gap in the directions of cutting the magnetic fluxes in the magnetic fields produced between the opposing magnet blocks. This arrangement provides a high density of magnetic fluxes and a high output voltage and improves the quality of signals reproduced. This effect is promoted further by yoke plates of a material of high magnetic permeability arranged to straddle the open magnet poles of the side-to-side magnets, thereby inhibiting leak of magnetic fluxes from these open poles. Vertical compliance of the vibration system can be made small during tracing a warped record disk by the use of an asymmetrically shaped armature. Good contact of damper to armature can be secured by fitting the armature into the damper. This cartridge may be made integral with head shell.

33 Claims, 26 Drawing Figures

PICKUP CARTRIDGE FOR REPRODUCING SIGNALS RECORDED ON A 45-45 STEREOPHONIC RECORD DISK

BACKGROUND OF THE INVENTION (a) Field of the invention:

The present invention relates generally to a pickup cartridge intended to playback record disks, and it pertains especially to a moving-coil type pickup cartridge functioning in push-pull mode wherein moving coils are arranged to be displaced almost linearly across the magnetic fluxes in magnetic fields produced between opposing magnets.

(b) Description of the prior art:

In those known moving-coil type pickup cartridges wherein the moving coils are designed to be moved substantially linearly, it is generally easy to arrange so that a moving coil is disposed in a narrow air gap defined between magnets which form magnetic fields and that the coil cuts the magnetic flux always perpendicularly to this flux in the air gap. The narrow air gap will ensure the development of higher intensity of magnetic field in the air gap. Because of this higher intensity of the magnetic field and the perpendicular cutting of the magnetic fluxes by the moving coil, such known arrangement of the moving coil has the inherent advantage to provide a higher efficiency of movement-electromagnetism conversion and a high output voltage. This known coil arrangement will therefore allow its formation on a light bobbin of any non-magnetic material rather than on a heavy bobbin of magnetizable material, without the accompaniment of a considerable decrease in the conversion efficiency. This fact will serve to decrease the effective mass of a vibration system in the pickup cartridge, improving mechanical characteristics of the pickup cartridge, such as compliance, trackability or the like.

However, the above-mentioned advantages are not completely materialized in the prior art pickup cartridges, as will be discussed below.

A typical arrangement of the movement-electromagnetism conversion system according to the prior art is conceptually shown in FIG. 1, with the moving coil 1 being situated at its neutral position. As noted in FIG. 1, only upper half 1*a* of the moving coil 1 is located within the magnetic field 2, and the remaining lower half 1*b* resides outside this magnetic field 2. In accordance with the movement of the cantilever (not shown) in the pickup cartridge, the moving coil 1 is caused to move substantially linearly in a plane perpendicular to the magnetic flux which is generally indicated at B in the magnetic field 2, and more particularly in such manner that said one half 1*a* cuts the magnetic flux B inducing an electromotive force corresponding to the movement of the moving coil 1. With this arrangement, however, the two halves of the moving coil 1 have different characteristics of displacement-electromagnetism conversion relative to each other so that the induced signal contains undesired asymmetrical distortion. Also, this known arrangement has another inconvenience due to the leakage magnetic flux around the magnetic field 2. Namely, the magnetic field 2 is usually formed between two opposite magnet poles separated via an air gap; and around these poles, there always exist some leakage magnetic flux. Therefore, it is not possible to define the boundary of the magnetic field 2 by a straight line. Thus, actual magnetic field distribution in the movement-electromagnetism conversion system may take the pattern as shown in FIG. 2, wherein the shaded part represents a leakage magnetic field formed outside the magnetic field 2 due to the leakage magnetic flux. The moving coil 1, when cutting the leakage flux, induces an electromotive force in its lower half 1*b* which is opposite in polarity to that of the electromotive force in its upper half 1*a*. As a result, the level of the output signal is decreased. Furthermore, the intensity of the leakage magnetic field varies with the distance from the magnet, and the aimed magnetic field 2 is affected by the varying leakage magnetic field so that the intensity of the aimed magnetic field 2 will change non-linearly, particularly in the boundary region as shown in FIG. 2. Consequently, the output signal from the moving coil 1 is susceptible to present non-linear distortions due to the aforementioned non-uniformity of the magnetic field. Needless to say, it is impossible to locate the whole moving coil 1 within a common uniform magnetic field, because, if so arranged, electromotive forces induced in the two halves of the moving coil 1 will cancel each other to deliver no output signal.

Another arrangement of the movement-electromagnetism conversion system according to the prior art, which is disclosed in the laid open Japanese Utility Model Application No. 52-73703, is schematically illustrated in FIGS. 3 and 4, wherein the moving coil 9 is shown to be situated at its neutral position. The moving coil 9 is arranged on a coil support plate 7 extending from a cantilever 8 into an air gap defined between a pair of permanent magnets 5*a* and 5*b*. Each of the permanent magnets 5*a* and 5*b* is magnetized so as to have an N-pole at its middle portion and S-poles at its extremity portions. Therefore, two opposite-direction magnetic fields 6*a* and 6*b* are generated along the inner surfaces of the magnets 5*a* and 5*b*, as shown. As most clearly depicted in FIG. 4, one half 9*a* of the moving coil 9 is associated with flux $B_1$ in the magnetic field 6*a*, and the other half 9*b* is associated with flux $B_2$ in the magnetic field 6*b*.

SUMMARY OF THE INVENTION

It is, therefore, a primary object of the present invention to provide a pickup cartridge of moving coil type which includes an improved movement-electromagnetism conversion system and which, due to a highly elevated density of magnetic fluxes in magnetic field, is capable of reproducing signals carried on a record disk with a high sensitivity and a good fidelity.

In one aspect of the pickup cartridge according to the present invention, moving coils are each formed with at least one turn of conductor arranged spirally on a flat coil support plate and each is caused to move in a direction parallel to this coil support plate within a narrow air gap. The moving coil is associated with a first magnetic flux perpendicular to the coil support plate and also with a second magnetic flux perpendicular to the coil support plate and inverse in direction to the first magnetic flux.

The above and other objects as well as the features and advantages of the present invention will become apparent by reading the following detailed description of the preferred embodiments when taken in conjunction with the accompanying drawings.

DETAILED DESCRIPTION OF THE PREFERRED EMBODIMENTS

Referring to FIGS. 5 to 9, an example of pickup cartridge according to the present invention will be explained hereunder.

Figure 1:
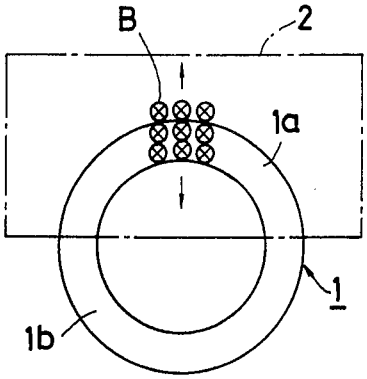
FIG. 1 PRIOR ART
FIG. 1 shows conceptually a typical arrangement of a movement-electromagnetism conversion system according to the prior art, in which a moving coil is shown at its neutral position in a magnetic field.
Figure 3:
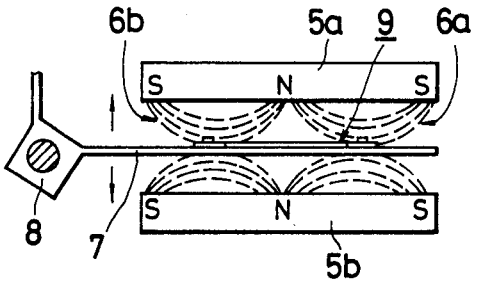
FIG. 3 PRIOR ART
FIG. 3 shows schematically another arrangement of a movement-electromagnetism conversion system according to the prior art, in which a moving coil is shown at its neutral position.
Figure 2:
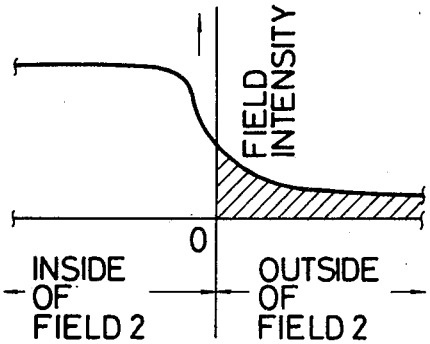
FIG. 2 PRIOR ART
FIG. 2 shows an example of magnetic field distribution in the movement-electromagnetism conversion system shown in FIG. 1, in which a shaded part indicates a magnetic field due to leakage magnetic fluxes.
Figure 4:
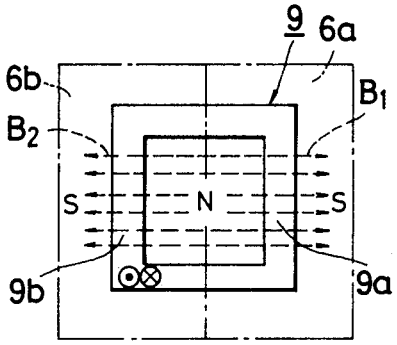
FIG. 4 PRIOR ART
FIG. 4 schematically illustrates the association of the moving coil and magnetic fields in the conversion system shown in FIG. 3.
Figure 5:
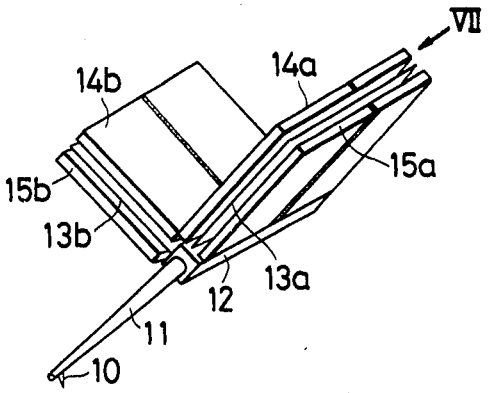
FIG. 5 diagrammatically shows in perspective view an example of a pickup cartridge according to the present invention, in which only an essential part including a vibration system and a movement-electromagnetism conversion system is illustrated.

An essential part of the pickup cartridge is shown diagrammatically in FIG. 5 in perspective view, which comprises a vibration system for picking up undulations formed on the wall surfaces which constitute a sound groove of a record disk (not shown), and a movement-electromagnetism conversion system for converting the movements of the vibration system caused by the picking-up of said undulations of the walls of the groove into corresponding electromotive forces. The vibration system includes a cantilever 11 carrying at its foremost end a stylus tip 10 for tracing the record disk groove, an armature member or coil unit support member 12 attached to the base portion of the cantilever 11, and a supporting means (not shown) for supporting the cantilever 11 to a body member (not shown) of the pickup cartridge assembly so as to permit only swinging movements of the cantilever 11 about a certain fulcrum point and to exclude the axial movements of this cantilever. The supporting means may, usually, be composed of a suspension wire for pulling the base portion of the cantilever 11 toward the pickup cartridge body member, and a damper member made of an elastic material for properly damping the swinging movements of the cantilever 11. The movement-electromagnetism conversion system is made with two coil units 13*a* and 13*b* which are attached to the armature member 12 on the cantilever 11, and four magnet blocks 14*a*, 14*b*, 15*a* and 15*b* which are fixed to the pickup cartridge body member.

Figure 6:
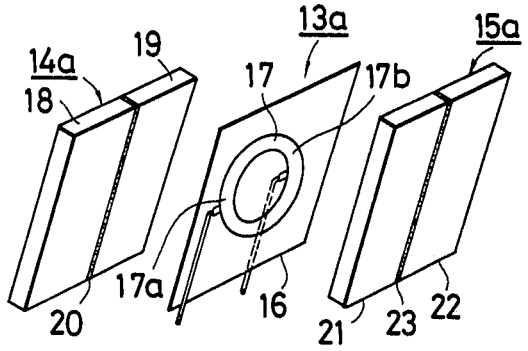
FIG. 6 shows, in exploded perspective view, only an explanatorily helpful part of the movement-electromagnetism conversion system shown in FIG. 5.

As shown clearly in FIG. 6 which is an exploded perspective view of one coil unit 13*a* and a pair of magnet blocks 14*a* and 15*a*, the coil unit 13*a* is composed of a thin coil support plate 16 made of, for instance, silicon and a flat spiral-shaped moving coil 17 formed by at least one turn of conductor spirally arranged on the coil support plate 16. This moving coil 17, in turn, may be formed by relying on the selective photo-etching technique to deposit a conducting film of copper, aluminum or the like onto the coil support plate 16. The coil support plate 16 of the coil unit 13*a* is secured to the armature member 12 in FIG. 5 so as to extend outwardly at an inclination angle of 45 degrees from a vertical plane containing the center axis of the cantilever 11 relative to the horizontal surface of a record disk in the state of the stylus being engaged in the groove of the disk. The magnet block 14*a* is formed with a pair of permanent magnets 18 and 19 which are combined to each other by means of a layer of a binding agent 20 intervening therebetween. Similarly, the magnet block 15*a* consist of another pair of permanent magnets 21 and 22 combined with each other via an intervening layer 23 of a binding agent. The respective magnet blocks 14*a* and 15*a* are arranged to face each other via an air gap defined therebetween. In this pickup cartridge, mechanical vibrations of the stylus tip 10 during its run in the groove of a record disk is transmitted, via the cantilever 11 and the armature 12, to the coil units 13*a* and 13*b*, and voltages, i.e. electromotive forces, are induced in the coils 17 and 17 of these coil units.

Figure 7:
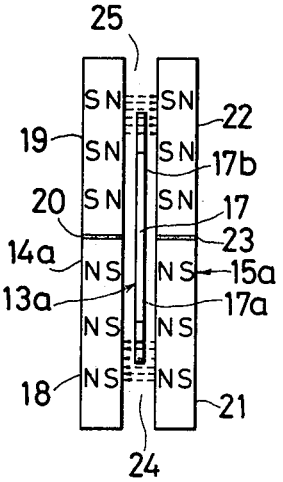
FIG. 7 is an enlarged view of a part of the movement-electromagnetism conversion system of FIG. 5, as viewed in a direction indicated by arrow VII in FIG. 5, in which one moving coil and a pair of magnet blocks for producing magnetic fields for the coil are shown.
Figure 8:
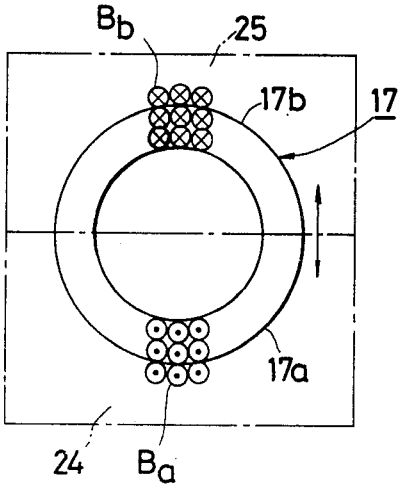
FIG. 8 schematically shows the association of the moving coil shown in FIG. 7 with the magnetic fields.
Figure 9:
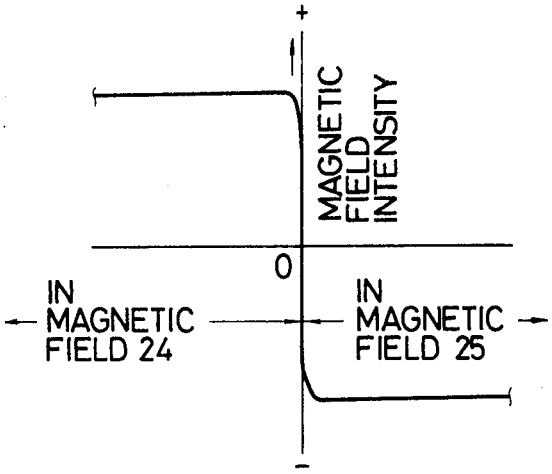
FIG. 9 shows an example of magnetic flux distribution in the magnetic fields established by the magnet blocks shown in FIG. 7.

The manner of magnetization of the magnet blocks 14*a* and 15*a* is explained by referring to FIG. 7, wherein these magnet blocks are viewed in a direction indicated by arrow line VII in FIG. 5 and a part of the coil support plate 16 is omitted for simplicity. As seen, the permanent magnets 18 and 22 are magnetized in the direction of their thicknesses to have their S-poles established on their inner surfaces and their N-poles established on their outer surfaces, respectively. Whereas the other permanent magnets 19 and 21 are magnetized in the direction of their thicknesses to have their N-poles on their inner surfaces and their S-poles on their outer surfaces, respectively. Thus, there are developed two discrete magnetic fields 24 and 25 so as to traverse, across the air gap, toward each other's entire inner surfaces of the magnets 18 and 21 and similarly toward each other's entire inner surfaces of the magnets 19 and 22, respectively, with these magnetic fields 24 and 25 being opposite in direction relative to each other. Therefore, as shown schematically in FIG. 8, when the moving coil generally indicated at 17 is at its neutral position, the frontside half 17*a* (lower half in FIG. 8) of the moving coil 17 is associated with magnetic flux $B_a$ in the magnetic field 24, and the rearside half 17*b* (upper half in FIG. 8) is associated with magnetic flux $B_b$ in the magnetic field 25. In FIG. 8, the magnetic flux $B_a$ in the magnetic field 24 are shown extending in the direction of crossing the sheet of drawing from this side to the other side, while the magnetic flux $B_b$ in the magnetic field 25 are illustrated as extending in the opposite direction of crossing the sheet of drawing. FIG. 9 illustrates the magnetic field distribution in the air gap defined between the magnet blocks 14*a* and 15*a*. As will be seen from FIG. 9, each of the two magnetic fields 24 and 25 has a substantially uniform intensity, and the transition curve between the magnetic fields 24 and 25 is noted to be quite clear. Needless to say, the leakage magnetic fluxes, which can exist near the air gap between the magnet blocks 14*a* and 15*a*, have no ill effect upon the moving coil 17, since no part of this moving coil 17 is located outside the air gap.

The arrangement of the other coil unit 13*b*, magnet blocks 14*b* and 15*b* is essentially the same as that of the coil unit 13*a* and magnet blocks 14*a* and 15*a*, which has been described above by referring to FIGS. 6 to 9, with the exception that the coil support plate of the coil unit 13*b* is attached to the armature member 12 so as to extend upward with an inclination angle of 45 degrees with respect to the vertical plane containing the cantilever center axis relative the horizontal surface of the record disk in the direction away from the other of the paired coil support plate.

The operation of this example of the pickup cartridge is as follows. When the vibration system of the pickup cartridge is caused to vibrate around a vibration center, the moving coil units 13*a* are displaced in response to the swinging movements of the cantilever 11, while intercepting the magnetic fluxes in the magnetic fields 24 and 25 perpendicularly of these magnetic fluxes. As a result, electromotive forces related with the movements of the cantilever 11 are induced in each of the moving coils 17, 17 of the coil units 13*a* and 13*b*. As has been explained, each moving coil 17 is arranged so that, when it is at its neutral position, its one half is rendered to be associated with a first magnetic field 24 for example, and the other half is rendered to be associated with a second magnetic field 25 for example which is inverse in polarity to the first magnetic field 24. Accordingly, the whole of each moving coil 17 in actual operation serves to generate electromotive forces corresponding to the displacements thereof in a so-called "push-pull" mode, because of the fact that the directions of the magnetic flux $B_a$ and the magnetic flux $B_b$ are opposite to each other, and that accordingly the voltages induced in one half and the other half of the coil 17 are of the same phase, and that the output voltage derived at the entire coil is the sum of these voltages. As a result, there is obtained a higher conversion efficiency, i.e. a higher level of output of the movement-electromagnetism conversion system in this pickup cartridge. Furthermore, the moving coil units 13*a* and 13*b* are designed to intercept substantially perpendicularly the magnetic flux in their operation to generate an electromotive force. This contributes to increasing the conversion efficiency of the movement-electromagnetism conversion system of the present invention. Still further, the magnetic fields associated with each moving coil have such a uniform intensity distribution as shown in FIG. 9, and are not effected by leakage fluxes, so that only a negligibly small amount of asymmetrical and non-linear distortion is contained in the output signal of each moving coil in this pickup cartridge.

It should be noted here that the pickup cartridge of the instant example is arranged so that the respective moving coil units are inclined in outwardly flaring style at an angle of 45 degrees each with respect to the vertical plane containing the center axis of the cantilever. This means that the respective moving coils are sensitive to the components of the swinging movements of the cantilever in the directions each at an angle of 45 degrees to the surface of a record disk. Therefore, when a 45—45 stereophonic record disk is played by the use of this instant example of the pickup cartridge, the left-channel signal will be delivered from the moving coil unit 13*a* of the pair, and the right-channel signal will be delivered from the other moving coil unit 13*b* of the pair.

Figure 10:
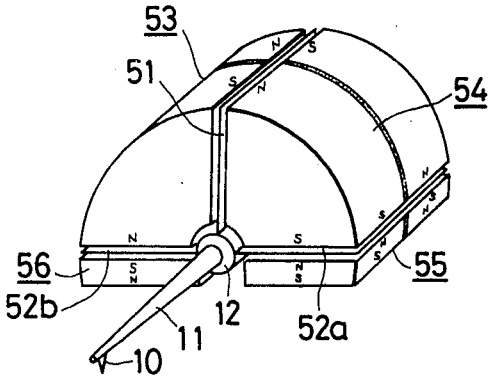
FIG. 10 shows in diagrammatic perspective view another example of a pickup cartridge according to the present invention, in which only an essential part including a vibration system and a movement-electromagnetism conversion system is illustrated.

Another example of a pickup cartridge according to the present invention is shown in FIG. 10 in diagrammatic perspective view. This example of pickup cartridge differs from the previous embodiment only in the arrangement of the movement-electromagnetism conversion system, though same in principle as the preceding example. That is, the conversion system in this instant embodiment comprises one vertical coil unit 51 for converting the vertical component of movement of a cantilever 11 to an electromotive force, and two horizontal coil units 52*a* and 52*b* for converting the horizontal component of movement of the cantilever 11 to electromotive forces. The structure of each coil unit per se may be the same as that in the previous example. The vertical coil unit 51 is provided on the armature member 12 to extend vertically in an air gap defined between two magnet blocks 53 and 54 which are arranged in a semicircular cylindrical fashion at one side of an armature member 12. The horizontal coil units 52*a* and 52*b* are symmetrically provided on the armature member 12 to extend horizontally in an air gap between the magnet blocks 54 and 55 and in an air gap between the magnet blocks 53 and 56, respectively. Each of the magnet blocks 53 to 56 is formed with a frontside permanent magnet and a rearside permanent magnet which are combined together by means of a binding agent, and magnetized in such a manner as shown in FIG. 10, so that two magnetic fields, which are opposite in direction to each other, are developed across each air gap. More particularly, the front and rear halves of the moving coil (not shown) of each coil unit are associated with a first magnetic field developed by the frontside permanent magnets of corresponding paired two magnet blocks, and with a second magnetic field which is opposite in direction to said first magnetic field and developed by the rearside permanent magnets of those corresponding magnet blocks, respectively, as in the case of the previous embodiment.

Description will hereunder be made on the operation of this instant example. When a 45—45 stereophonic record disk is played by the use of this pickup cartridge, and when the cantilever 11 is caused to vibrate in accordance with the undulations of the wall surfaces of a groove of a record disk, an electromotive force corresponding only to the vertical component of movement of the cantilever is induced in the moving coil of the vertical coil unit 51 and an electromotive force corresponding only to the horizontal component of movement of the cantilever is induced in the moving coil of each of the horizontal coil units 52*a* and 52*b*. In a 45—45 stereophonic disk, as well known, left-channel signals are recorded in the form of undulations of surface on one wall of the record groove which is formed at an inclination angle of 45 degrees relative to the record surface, and right-channel signals are recorded similarly on the other wall of the record groove wall which is inclined at an even angle of 45 degrees relative to the record surface and perpendicular to said one wall of the groove. More particularly, in the walls of the groove of a record disk, a sum signal of left and right channel signals is recorded horizontally, and a differential signal between the left and the right channel signals is recorded vertically. Therefore, by, for example, obtaining a sum voltage of the voltage generated by horizontal vibration of the coil in the horizontal coil unit 52*a* and the voltage generated by vertical vibration of the coil in the vertical coil unit 51, there is derived a left-channel signal output. Likewise, by obtaining a differential voltage between the voltage generated by the horizontal vibration of the coil in the horizontal coil unit 52*b* and the voltage generated by the vertical vibration of the coil in the vertical coil unit 51, there is derived a right-channel signal output. Hence, the vertical component of movement of the cantilever is related with the differential signal between the right- and left-channel signals, while the horizontal component of movement is related with the sum signal of the two channel signals. Accordingly, if the moving coils of the coil units 51, 52*a* and 52*b* are adequately interconnected externally or internally of the cartridge, there can be reproduced separately the right-channel signal and the left-channel signal. For example, the moving coils of the coil units 51 and 52*a* may be interconnected to deliver the sum signal of their electromotive forces as the left-channel signal, and the moving coils of the coil units 51 and 52*b* may be interconnected to deliver the difference signal of their electromotive forces as the right-channel signal.

Figure 11:
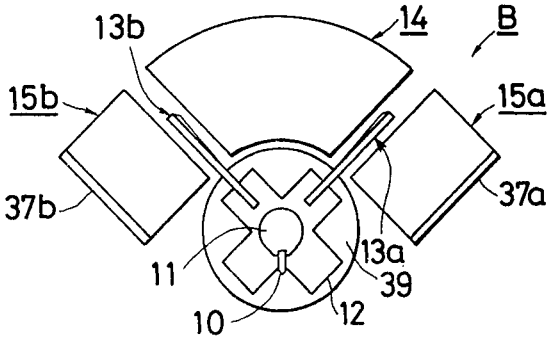
FIG. 11 shows in diagrammatic front elevation another example of a pickup cartridge according to the present invention, in which only an essential part including a vibration system and a movement-electromagnetism conversion system is illustrated.
Figure 12:
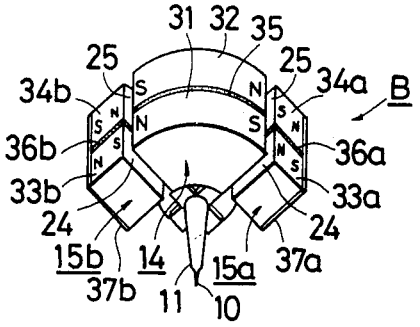
FIG. 12 is a diagrammatic perspective view of the essential part of the pickup cartridge shown in FIG. 11.
Figure 13:
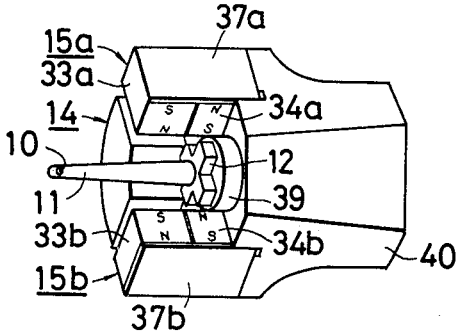
FIG. 13 is a diagrammatic perspective bottom view of the pickup cartridge shown in FIG. 11.
Figure 14:
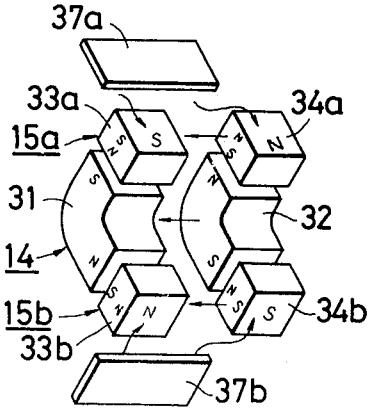
FIG. 14 is an exploded fragmentary explanatory perspective view of the pickup cartridge shown in FIG. 11, as viewed from the bottom side thereof.

In FIGS. 11 to 14 is shown an example of a pickup cartridge according to the present invention, which is a modification of the preceding embodiment shown in FIGS. 5 to 9. In this instant example, means for producing magnetic fields for linkage with the coil units 13*a* and 13*b* is comprised of three separate magnetic blocks 14, 15*a* and 15*b* which are arranged in a substantially circular fashion around an armature member 12. The magnet block 14 is formed with a pair of front and rear permanent magnets 31 and 32 which are combined together by an intervening binding agent layer 35; the magnet block 15*a* is formed with a pair of front and rear permanent magnets 33*a* and 34*a* combined together likewise by a binding agent layer 36*a;* and the magnet block 15*b* is formed with a pair of front and rear permanent magnets 33*b* and 34*b* combined together via an intervening binding agent layer 36*b*. The respective permanent magnets of the magnet blocks 14, 15*a* and 15*b* are magnetized in such a manner as shown in FIGS. 12 and 14. In each air gap, there are developed such a pair of magnetic fields as explained with reference to FIGS. 7, 8 and 9, so that the respective moving coils of the coil units 13*a* and 13*b* can perform the conversion function in a "push-pull" mode, like in the preceding embodiments. The magnetic field producing means in this example further includes yoke members 37*a* and 37*b* of a material of a high magnetic permeability, and they are arranged to straddle across the open ends, i.e. open magnetic poles, of the front and rear magnets 33*a* and 34*a* and across the open ends, i.e. open magnetic poles, of the front and rear magnets 33*b* and 34*b*, respectively. It should be noted that these open magnetic poles represent the magnetic poles opposite to those magnetic poles which constitute the magnetic gap 24 or 25. These yoke members 37*a* and 37*b* constitute passages of magnetism between these open magnetic poles in said front and rear magnets 33*a*, 33*b* and 34*a*, 34*b*, respectively, and greatly reduce the leak of magnetic fluxes which otherwise could occur through these open magnetic poles. These yoke members also serve to greatly reduce the reluctance of a closed magnetic circuit comprising the magnet blocks 14, 15*a* and 15*b*, and the yoke members per se, thereby allowing the development of magnetic fields of a higher intensity within each air gap across the magnetic circuit. This will eventually serve to increase the conversion efficiency of the movement-electromagnetism conversion system.

The armature member 12 employed in this instant example is formed generally with a non-magnetic material such as plastics or aluminum in a crisscross shape, and has four projections extending divergently in four outward directions from the center thereof. The respective coil units 13*a* and 13*b* are fixed to their mating ones of the projections of the armature member 12. In FIGS. 11 to 13, a disk-like damper member 39 of an elastic material such as rubber is shown, and it is interposed between the armature member 12 and a supporting member 40 which is shown in FIG. 13 and on which are provided the magnet blocks 14, 15*a* and 15*b*.

Referring now to FIGS. 15 to 19, description will hereunder be made on some examples of further arrangement for simultaneously optimizing the vibration characteristics with respect to vertical as well as horizontal components of vibration of the vibration system employed in the pickup cartridge of the present invention.

Figure 15:
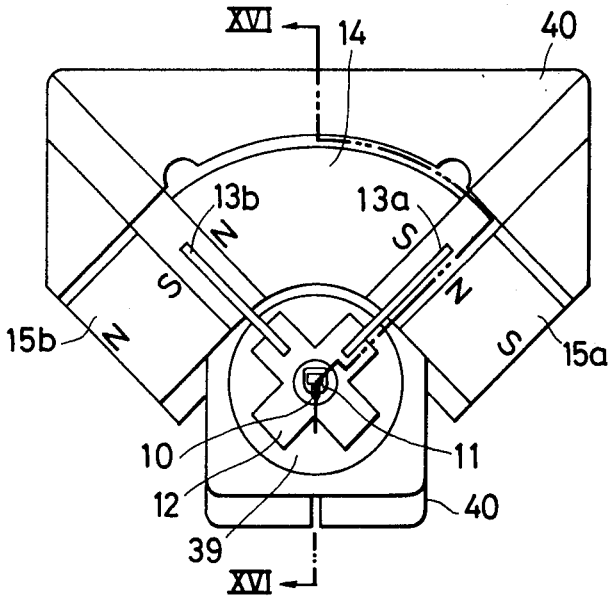
FIG. 15 shows in diagrammatic front elevation another example of a pickup cartridge according to the present invention, viewed in the axial direction of the cantilever.
Figure 16:
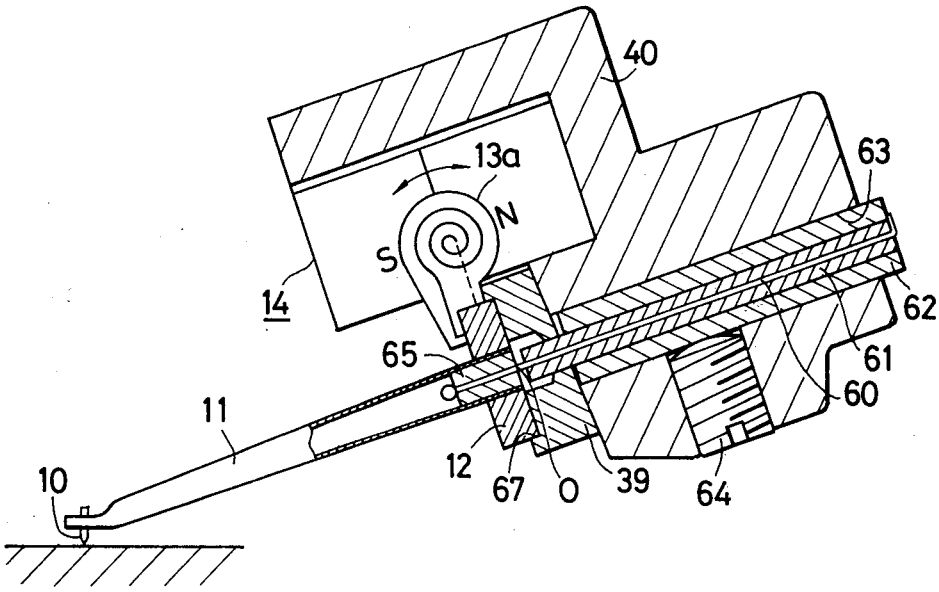
FIG. 16 is a diagrammatic sectional view of the pickup cartridge of FIG. 15, taken along line XVI—XVI, when placed on a disk to locate the coil units in their neutral positions.
Figure 17:
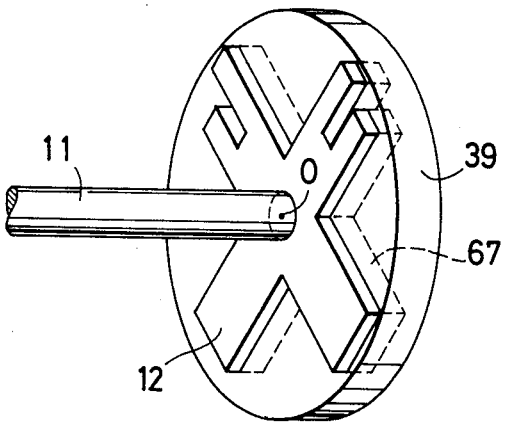
FIG. 17 shows in enlarged diagrammatic perspective view an armature member or coil unit support member and a damper member used in the pickup cartridge shown in FIGS. 15 and 16.

In FIGS. 15 and 16, there is shown an example of pickup cartridge embodying the present invention, which is similar in general arrangement and principle to the preceding example explained in connection with FIGS. 11 to 14. However, the armature member 12, in this instant example, may be made with a non-magnetizable material such as a synthetic resin or aluminum. This armature member 12 has such configuration that its upwardly divergingly extending two projections have portions having lengths greater than the lengths of the downwardly divergingly extending two projections. In other words, the armature member 12 has its upper half portion which is greater in length than the lower half portion, as shown in FIG. 15. The upper two projections of the armature member 12 have recesses respectively to support the coil units 13*a* and 13*b* at 45 degrees with respect to a vertical plane passing through the cantilever axis and on opposite sides of this plane. Besides, this armature member 12 is secured to a supporting member 40 via a damper member 39 which is made of an elastic material such as rubber. More particularly, that side of the damper member 39 located on the armature member side is provided with a corresponding X-shaped recess 67 in which the armature member is secured firmly. With this arrangement of the armature member 12 and the damper member 39, it should be understood that the vertical movement of the cantilever 11 is subjected to a greater damping action of the damper member 39 than the horizontal movement of the cantilever 11 is damped, even if the damper member 39 has a uniform compliance throughout its entire portion. Thus, the horizontal vibration characteristic of the vibration system differs from the vertical vibration characteristic thereof. In other words, the vibration system in this instant example of the pickup cartridge is given a higher stiffness for vertical movements thereof than for horizontal movements thereof. This vibration characteristic of the vibration system is usually preferred for the following reasons.

The vibration system in a pickup cartridge tends to be placed under an influence of several factors such as (a) extraneous vibration, (b) the weight of the cartridge per se, and (c) unnecessary vibration of a very low frequency caused by warping of the record disk which is to be reproduced. The extent of this influence exerted by these factors upon the movement of the vibration system is dependent on the directions of movements of the system. Namely, the weight of the cartridge and the very low frequency vibration due to warping of the record disk will affect mainly the vertical component of movements of the vibration system. Hence, it may be preferable for the vibration system to possess a relatively large stiffness for the vertical movements thereof for the purpose of decreasing such adverse influence caused by the warping of the record disk as well as by the weight of the cartridge. On the other hand, low frequency components of the recorded signals are picked up mainly by following the horizontal component of the movement of the vibration system. Therefore, the pickup cartridge preferably possesses a relatively large compliance for the horizontal component of movement in order to obtain a required level of the sensitivity for reproducing signals of a low frequency range. As such, the aforementioned vibration characteristic of the vibration system as explained by referring to FIGS. 15 and 16 is preferred.

Figure 18:
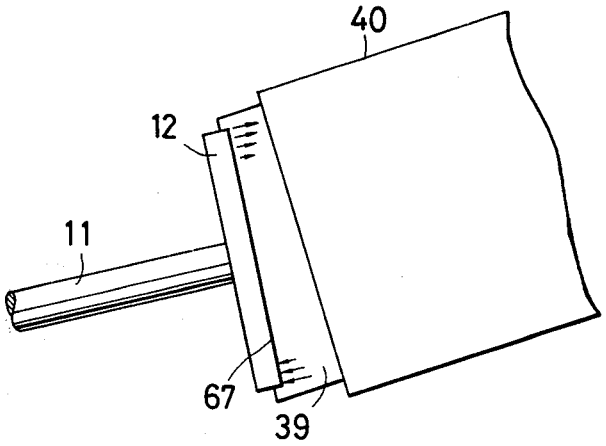
FIG. 18 is a schematic view for explaining the damping action by the damper member shown in FIGS. 15 to 17.

Referring again to FIG. 16, the tubular cantilever 11 is pulled toward the supporting member 40 by a suspension wire 60 which may be a piano string extending through a tubular member 61 which is securely inserted in a wire holder 62. This wire holder 62, in turn, is secured by a fastening means such as a screw 64 within a bore 63 formed in the supporting member 40. The base end of the suspension wire 60 is caulked onto the base end of the wire holder 62 for anchoring the suspension wire thereto, and the foremost end of this suspension wire 60 is secured to the base end of the cantilever 11 via a filling member 65 which is fixedly inserted in the tubular cantilever. As stated, in the damper member 39 is formed a recess 67 which has a dimension similar to but slightly smaller than that of the armature member 12, and also is formed a central hole through which the foremost end of the tubular member 61 is inserted. The armature member 12 is forced into the recess 67 of the damper member 39, as will be seen more clearly in FIG. 17. The armature member 12 may be secured within this recess 67 by means of an appropriate binding agent. This armature member 12 and the damper member 39 are always kept, with good adherency to each other because the armature member 12 is firmly held in the recess 67 of the damper member 39, so that the damper member can smoothly deform in all directions as shown in FIG. 18, without spontaneous local detachment from the armature member 12, for all the swinging movements of the armature 12 around a vibration center indicated at 0 in FIG. 16. As a result, the damping action by this damper member 39 is highly stabilized.

Figure 19A:
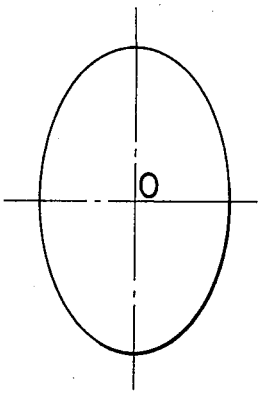
FIGS. 19A, 19B and 19C show possible examples of front elevation of various armature member employed in the pickup cartridge shown in FIGS. 15 and 16.
Figure 19B:
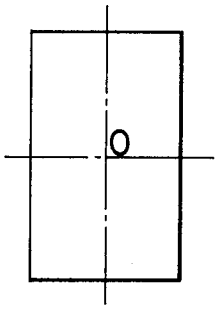
Figure 19C:
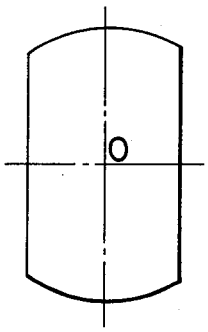

It should be noted here that the armature member 12 in the pickup cartridge shown in FIGS. 15 and 16 may have such front elevational configurations as those shown in FIGS. 19A, 19B and 19C, as required, so as to provide a relatively large damping action on the vertical vibration of the cantilever and a relatively small damping action in the horizontal direction.

Figure 20:
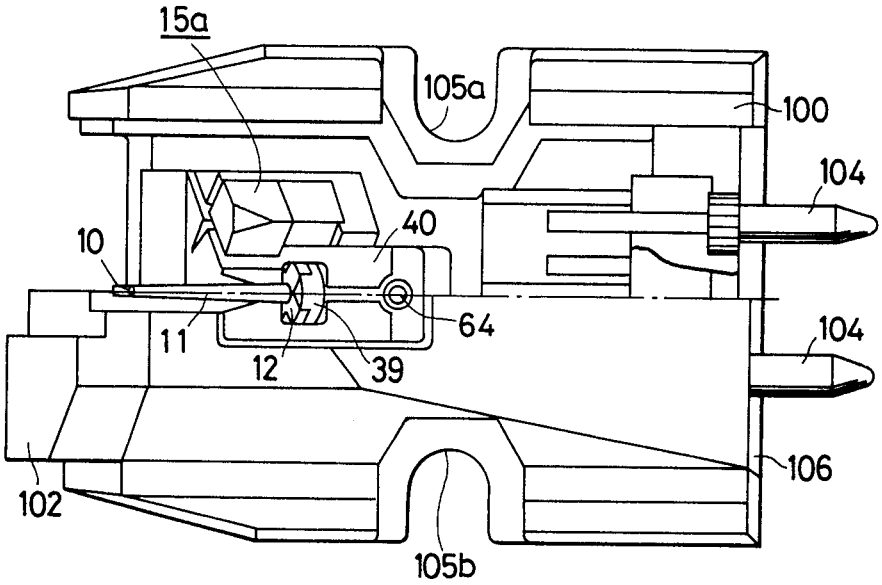
FIG. 20 is a partially cut-away diagrammatic bottom plan view of an example of a complete pickup cartridge assembly according to the present invention, in which a pickup cartridge unit of the present invention such as shown in FIGS. 15 and 16 is incorporated.
Figure 21:
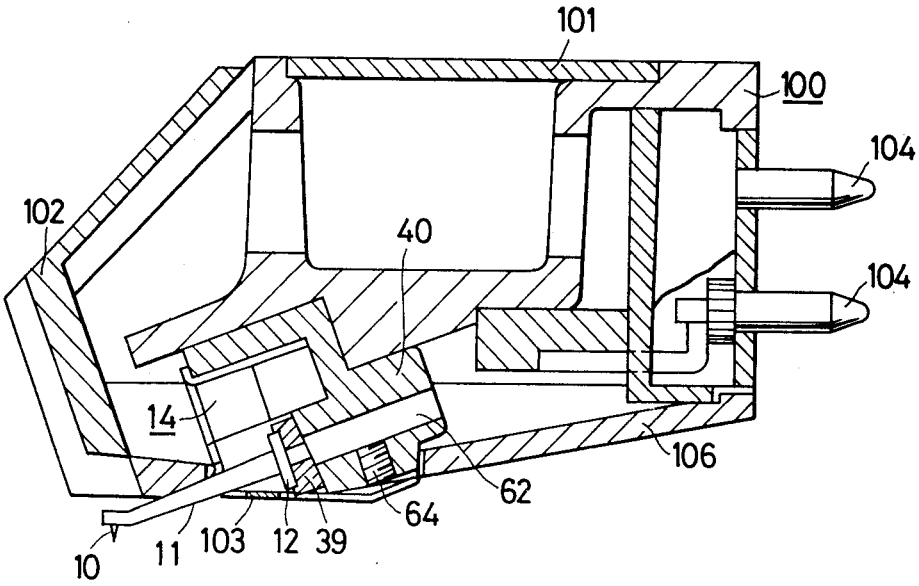
FIG. 21 is a diagrammatic vertical sectional view of the pickup cartridge assembly shown in FIG. 20.

FIG. 20 is a partially cut-away explanatory bottom view of an example of a complete pickup cartridge assembly embodying the present invention, in which a pickup cartridge unit of the present invention such as that shown in FIGS. 15 and 16 is employed. FIG. 21 is a vertical sectional view of the pickup cartridge assembly shown in FIG. 20. In these figures, reference numeral 100 indicates a housing in which the pickup cartridge unit is assembled. This housing 100 is furnished with a top plate 101, a front cover 102, a bottom plate 106 and four contact pins 104. The cantilever 11 of the pickup cartridge unit extends outwardly of the cartridge unit at an appropriate angle relative to the horizontal surface of a record disk through an opening formed locally in the wall of a bottom cover 103 which is attracted to the cartridge unit for protectively covering the vibration system and movement-electromagnetism conversion system of the cartridge unit. The outputs from the conversion system are transmitted to the contract pins 104 through wiring not shown. These contact pins or plugs 104 are inserted to fit in their mating sockets provided on a head shell not shown which, in turn, is attached to a pickup arm of a record player. The housing 100 has, at its sides, recesses 105*a* and 105*b* for the insertion of fastening means such as screws to secure the pickup cartridge assembly onto the head shell. The damper member 39 may be made of a material such as butyl rubber, in addition to those material mentioned already in the preceding example.

Figure 22:
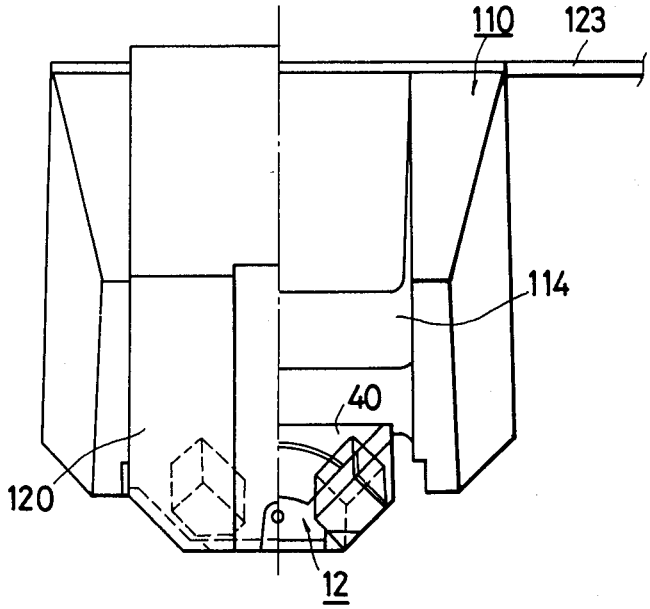
FIG. 22 is a partially cut-away, diagrammatic front elevational view of an example of complete pickup cartridge assembly according to the present invention, which incorporates a pickup cartridge unit of the present invention such as shown in FIGS. 15 and 16, and which is equipped with means for mechanically and electrically coupling the assembly directly to a pickup arm without a head shell which is usually employed for the coupling of a most conventional pickup cartridge assembly.
Figure 23:
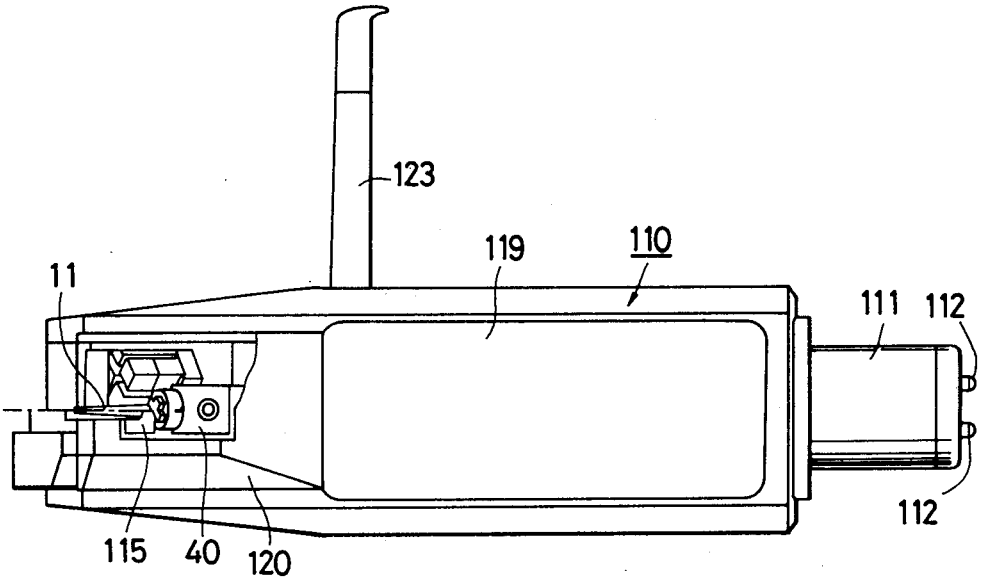
FIG. 23 is a partially cut-away, diagrammatic bottom view of the pickup cartridge assembly shown in FIG. 22.
Figure 24:
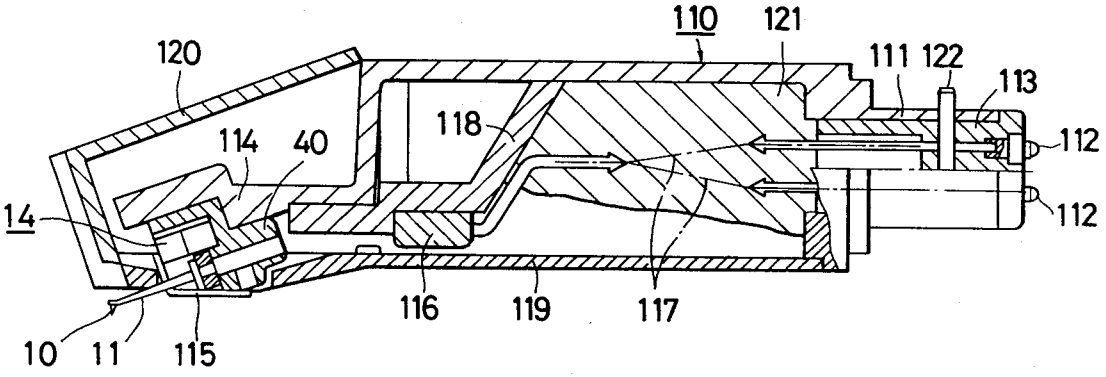
FIG. 24 is a partially cut-away, diagrammatic longitudinal sectional view of the pickup cartridge assembly shown in FIGS. 22 and 23.

Another example of the pickup cartridge assembly according to the present invention will hereunder be described by referring to FIGS. 22 to 24, wherein FIG. 22 is a partially cut-away front elevation view of the assembly. FIG. 23 is a partially cut-away bottom view of this assembly. FIG. 24 is a vertical sectional view of this assembly. Reference numeral 110 indicates a housing wherein a pickup cartridge unit of the present invention such as shown in FIGS. 15 and 16 is accommodated, which housing being formed from rigid material such as aluminum and zinc. At the base end of this housing 110, there is integrally formed a projection 111 having a guide pin 122 which is engaged with an internally threaded movable sleeve (not shown) provided on a pickup arm to which this assembly is to be attached. Inside this projection 111, four contact pins or plugs 112 are securely inserted via a member 113 to extend outwardly from the end of this projection 111. The contact pins 112 are to be fit into their mating sockets provided on a pickup arm when the assembly is attached to the pickup arm by means of said projection 111. The pickup cartridge unit is rigidly attached to the foremost end portion 114 of the housing 110. For example, the supporting member 40 of the pickup cartridge unit is attached to the foremost end portion 114 by means of a binding agent, or it may be formed integrally with the foremost end portion 114. The cantilever 11 of the pickup cartridge unit extends outwardly at an appropriate angle through an opening formed locally in a bottom cover 115 which is attached to the underside of the cartridge unit. The outputs of the movement-electromagnetism conversion system of the pickup cartridge unit are transmitted through wiring not shown to terminals provided on a terminal board 116, and therefrom they are connected to the contact pins 112 via wires 117. This terminal board 116 is fixed onto a support member 118 which is rigidly attached to or integrally formed with the housing 110. On the bottom side of the housing 110 is attached a protective bottom plate 119, and on the front side there is provided a protective front cover 120. The space within the housing 110 is filled with a relatively soft material 121 such as silicon resin and butyl rubber for preventing the undesirable development of resonating vibration of the cartridge including the wires 117. Numeral 123 indicates a handling piece for manipulating the pickup cartridge assembly by a finger of the user.

The pickup cartridge assembly described just above may be integrated in a rigid structure, and is provided with means 111 for mechanically coupling the assembly to a pickup arm, so that the assembly can be firmly attached directly to the pickup arm without the need of the assistance of a conventional head shell. Therefore, it is possible to prevent the development of such undesirable problems as unnecessary resonance, and related sharp peaks and dips in the frequency response curve of mechanical-to-electrical conversion characteristic as have been often encountered in many conventional pickup cartridges which are usually arranged so as to be attached to a head shell by means of screws and which tend to give rise to undesirable resonance due to insufficient strength of coupling between the head shell and the cartridge unit, and it is possible to fully utilize the functions of the pickup cartridge and to obtain good reproduction sounds.

In the respective examples described above, it should be understood that a pair of front and rear permanent magnets constituting each magnet block in the movement-electromagnetism conversion system according to the present invention may be formed integrally in a single magnet with two opposite poles formed on its surface, by sintering from fine powders of ferromagnetic substance such as barium ferrite and rare earth cobalt compound (samarium cobalt compound).

What is claimed is:

1. An improved pickup cartridge for reproducing signals recorded on a sound groove of a record disk wherein the groove is defined by wall surfaces having undulations thereon, the cartridge comprising:

a vibration system including a stylus tip for engaging the wall surfaces and moving in accordance with the undulations as the disk is displaced with respect to the stylus tip, an elongated cantilever carrying the stylus tip and movable in accordance with movement of said stylus tip, and means for supporting said cantilever to permit movement thereof; and a movement-electromagnetism conversion system responsive to the movement of said cantilever for converting said movement to electrical signals equivalent to the signals recorded on the sound groove, the improvement involving said movement-electromagnetism conversion system wherein the system includes:

at least one magnetic field producing means, each having an air gap and producing discrete first and second magnetic fields traversing respective adjacent first and second portions of said air gap, said first and second magnetic fields having substantially uniform intensity and oppositely directed magnetic fluxes with a sharp transition therebetween, said magnetic field producing means including:

a first pair of permanent magnet poles of opposite polarity separated by said first air gap portion and facing each other through said first air gap portion for producing said first magnetic field, and a second pair of permanent magnet poles of opposite polarity separated by said second air gap portion and positioned adjacent said first pair of permanent magnet poles, said second pair of permanent magnet poles facing each other through said second air gap portion and having pole polarities arranged inverse to the pole polarities of said first pair of permanent magnet poles relative to said air gap, for producing said second magnetic field; and at least one voltage-generating coil, each being associated with a respective one of said at least one magnetic field producing means and mechanically coupled to said cantilever and movable within the air gap of said associated magnetic field producing means in response to movement of said cantilever to cut perpendicularly the respective magnetic fluxes in said first and second magnetic fields of said associated magnetic field producing means to produce said electrical signals therein, and neutrally positioned in the air gap of said associated magnetic field producing means in such a manner that substantially one half thereof is located within said first magnetic field and substantially the other half thereof is located within said second magnetic field.

2. A pickup cartridge according to claim 1, in which: said coil is a flat spiral-shape arranged in a plane perpendicular to the magnetic fluxes in said first and second magnetic fields.

3. A pickup cartridge according to claim 1, further comprising two yoke members of magnetically permeable material, said pickup cartridge having two pairs to adjacent poles of opposite polarity external to said magnetic field producing means and each of said yoke members connecting a respective pair of adjacent poles for providing a closed path for magnetic flux, said closed path comprising a plurality of permanent magnets having said first and second pairs of permanent magnet poles of each magnetic field producing means, the first and second air gap portions associated with each magnetic field producing means, said two pairs of adjacent poles, and said yoke members.

4. A pickup cartridge according to claim 1, in which three magnetic field producing means are provided, the air gap of a first magnetic field producing means being located in a vertical plane passing through a longitudinal axis of said cantilever and said first magnetic field producing means having associated therewith a first voltage-generating coil, and the respective air gaps of a second magnetic field producing means and a third magnetic field producing means being located symmetrically about said vertical plane in a horizontal plane passing through said longitudinal axis and said second and third magnetic field producing means having associated therewith second and third voltage-generating coils, respectively, said first coil being arranged to induce therein an electromotive force corresponding to the component of movement of said cantilever in a direction perpendicular to a horizontal surface of said record disk, and said second and third coils being arranged to induce therein electromotive forces corresponding to the component of movement of said cantilever in a direction parallel to the horizontal surface of said record disk.

5. A pickup cartridge according to claim 4, in which: said first and second coils are interconnected to deliver a signal which is the sum of the electromotive forces induced in each coil and said first and third coils are interconnected to deliver a signal which is the difference between the electromotive forces induced in the first and third coils.

6. A pickup cartridge according to claim 1, in which two magnetic field producing means are provided, said two magnetic field producing means having respective air gaps located on respective opposite sides of a vertical plane passing through a longitudinal axis of said cantilever and arranged at respective angles of 45 degrees with respect to said vertical plane, the coil associated with one of said two magnetic field producing means being arranged to induce therein an electromotive force corresponding to the component of movement of said cantilever in a direction perpendicular to one of said groove walls, and the coil associated with the other of said magnetic field producing means being arranged to induce therein an electromotive force corresponding to the component of movement of said cantilever in a direction perpendicular to the other one of said groove walls.

7. A pickup cartridge according to claim 1 or 6, in which:

said stylus tip is secured to one end of said cantilever; and each coil associated with a respective one of said magnetic field producing means is supported on an armature member secured to the other end of said cantilever;

further comprising supporting means including a suspension wire for holding said other end of said cantilever and a damper member made of an elastic material which is secured to said armature member, said damper member has a recess formed therein for holding said armature.

8. A pickup cartridge according to claim 1 or 6, in which:

said vibration system and said movement-electromagnetism conversion system are assembled together into a single unit which is rigidly attached to a protective housing structure, said housing structure being provided with means for mechanically coupling said housing structure to a pickup arm, and wherein means are provided for electrically coupling said pickup arm to said movement-electromagnetism conversion system.

9. A pickup cartridge according to claim 8, in which: said housing structure contains therein a damping material for preventing resonance of the cartridge.

10. A pickup cartridge according to claim 9, in which: said damping material is a butyl rubber.

11. A pickup cartridge according to claim 1 or 6, in which:

said stylus tip is secured to one end of said cantilever; and each coil associated with a respective one of said magnetic field producing means is supported on an armature member secured to the other end of said cantilever;

further comprising supporting means including a suspension means for holding said other end of said cantilever and a damper member made of an elastic material which is secured to said armature member, said armature member having a shape enabling a component of movement of said cantilever in a direction perpendicular to a horizontal surface of said record disk to be subjected by said damper member to a damping force having a magnitude greater than the magnitude of the damping force to which a component of movement of said cantilever in a direction parallel with the horizontal surface of said record disk is subjected.

12. A pickup cartridge according to claim 11, in which: said armature member has an X-shaped configuration.

13. A pickup cartridge according to claim 11, in which: said damper member has a surface recess matching the shape of said armature member allowing said armature member to be tightly fit therein.

14. A pickup cartridge according to claim 11, in which each coil associated with a respective one of said magnetic field producing means is supported on a respective support plate made of silicon and attached to said armature member.

15. A pickup cartridge according to claim 14, in which each coil associated with a respective one of said magnetic field producing means is photo-etched on its respective support plate.

16. A pickup cartridge according to claim 14, in which: each respective coil support plate is secured to a respective one of two projections of said armature member, said armature member being X-shaped and said projections extending at 45 degrees with respect to, and on opposite sides of, a vertical plane passing through a longitudinal axis of said cantilever.

17. An improved pickup cartridge for reproducing signals recorded on a sound groove of a record disk wherein the groove is defined by wall surfaces having undulations thereon, the cartridge comprising:

a vibration system including a stylus tip for engaging the wall surfaces and moving in accordance with the undulations as the disk is disposed with respect to the stylus tip, an elongated cantilever carrying the stylus tip and movable in accordance with movement of said stylus tip, and means for supporting said cantilever to permit movement thereof; and a movement-electromagnetism conversion system responsive to the movement of said cantilever for converting said movement to electrical signals equivalent to the signals recorded on the sound groove, the improvement involving said movement-electromagnetism conversion system wherein the system includes magnetic field producing means comprising:

a first permanent magnet;

a second permanent magnet positioned in a direction parallel to said cantilever and adjacent to said first permanent magnet;

a third permanent magnet;

a fourth permanent magnet positioned in a direction parallel to said cantilever and adjacent to said third permanent magnet, a first air gap being formed between said first and third permanent magnets and a second air gap being formed between said second and fourth permanent magnets; one end of said first permanent magnet and one end of said third permanent magnet having opposite poles facing each other with said first air gap therebetween and one end of said second permanent magnet and one end of said fourth permanent magnet having opposite poles facing each other with said second air gap therebetween, a first magnetic field thereby traversing said first air gap and a second magnetic field thereby traversing said second air gap, said first and second magnetic fields being positioned adjacent one another and having oppositely directed magnetic fluxes; and a voltage-generating coil associated with said magnetic field producing means and mechanically coupled to said cantilever, comprising a first coil movable within said first and second magnetic fields in response to movement of said cantilever to cut perpendicularly the magnetic fluxes of said first and second magnetic fields to produce electrical signals in said first coil, said first coil being positioned in said first and second air gaps in such a manner that when said first coil is in a neutral position, substantially one half of said first coil is located within said first air gap and substantially the other half of said first coil is located within said second air gap.

18. A pickup cartridge according to claim 17, wherein said first coil is a flat spiral shape arranged in a plane perpendicular to the magnetic fluxes in said first and second magnetic fields.

19. A pickup cartridge according to claim 17, in which said stylus tip is secured to one end of said cantilever and said first coil is supported on an armature member secured to the other end of said cantilever; further comprising supporting means including a suspension wire for holding said other end of said cantilever and a damper member made of an elastic material which is secured to said armature member, said damper member having a recess formed therein for holding said armature.

20. A pickup cartridge according to claim 17, wherein said magnetic field producing means further comprises:

a fifth permanent magnet;

a sixth permanent magnet positioned in a direction parallel to said cantilever and adjacent to said fifth permanent magnet, a third air gap being formed between said third and fifth permanent magnets and a fourth air gap being formed between said fourth and sixth permanent magnets;

a seventh permanent magnet;

an eighth permanent magnet positioned in a direction parallel to said cantilever and adjacent to said seventh permanent magnet, a fifth air gap being formed between said fifth and seventh permanent magnets and a sixth air gap being formed between said sixth and eighth permanent magnets; the other end of said third permanent magnet and one end of said fifth permanent magnet having opposite poles facing each other with said third air gap therebetween and the other end of said fourth permanent magnet and one end of said sixth permanent magnet having opposite poles facing each other with said fourth air gap therebetween., a third magentic field thereby traversing said third air gap and a fourth magnetic field thereby traversing said fourth air gap, said third and fourth magnetic fields being positioned adjacent one another and having oppositely directed magnetic fluxes; and the other end of said fifth permanent magnet and one end of said seventh permanent magnet having opposite poles facing each other with said fifth air gap therebetween and the other end of said sixth permanent magnet and one end of said eighth permanent magnet having opposite poles facing each other with said sixth air gap therebetween, a fifth magnetic field thereby traversing said fifth air gap and a sixth magnetic field thereby traversing said sixth air gap, said fifth and sixth magnetic fields being positioned adjacent one another and having oppositely directed magnetic fluxes;

and wherein said voltage-generating coil further comprises:

a second coil movable within said third and fourth magnetic fields in response to movement of said cantilever to cut perpendicularly the magnetic fluxes of said third and fourth magnetic fields to produce electrical signals in said second coil, said second coil being positioned in said third and fourth air gaps in such a manner that when said second coil is in a neutral position, substantially one half of said second coil is located within said third air gap and substantially the other half of said second coil is located within said fourth air gap, and a third coil movable within said fifth and sixth magnetic fields in response to movement of said cantilever to cut perpendicularly the magnetic fluxes of said fifth and sixth magnetic fields to produce electrical signals in said third coil, said third coil being positioned in said fifth and sixth air gaps in such a manner that when said third coil is in a neutral position, substantially one half of said third coil is located within said fifth air gap and substantially the other half of said third coil is located within said sixth air gap;

said second coil being located in a vertical plane passing through a longitudinal axis of said cantilever so as to have induced therein an electromotive force corresponding to the component of movement of said cantilever in a direction perpendicular to a horizontal surface of said record disk; and said first and third coils being located about said vertical plane in a horizontal plane passing through said longitudinal axis so as to have induced therein an electromotive force corresponding to the component of movement of said cantilever in a direction parallel to a horizontal surface of said record disk.

21. A pickup cartridge according to claim 20, wherein said first, second and third coils are each of a flat spiral shape arranged in a plane perpendicular to the magnetic fluxes in said first and second magnetic fields, said third and fourth magnetic fields, and said fifth and sixth magnetic fields, respectively.

22. A pickup cartridge according to claim 17, in which said vibration system and said movement-electromagnetism conversion system are assembled together into a single unit which is rigidly attached to a protective housing structure, said housing structure being provided with means for mechanically coupling said housing structure to a pickup arm, and wherein means are provided for electrically coupling said pickup arm to said movement-electromagnetism conversion system.

23. A pickup cartridge according to claim 22, in which: said housing structure contains therein a damping material for preventing resonance of the cartridge.

24. A pickup cartridge according to claim 23, in which: said damping material is a butyl rubber.

25. A pickup cartridge according to claim 17, wherein said magnetic field producing means further comprises:

a fifth permanent magnet, and a sixth permanent magnet positioned in a direction parallel to said cantilever and adjacent to said fifth permanent magnet, a third air gap being formed between said third and fifth permanent magnets and a fourth air gap being formed between said fourth and sixth permanent magnets, the other end of said third permanent magnet and one end of said fifth permanent magnet having opposite poles facing each other with said third air gap therebetween and the other end of said fourth permanent magnet and one end of said sixth permanent magnet having opposite poles facing each other with said fourth air gap therebetween, a third magnetic field thereby traversing said third air gap and a fourth magnetic field thereby traversing said fourth air gap, said third and fourth magnetic fields being positioned adjacent one another and having oppositely directed magnetic fluxes;

and wherein said voltage-generating coil further comprises a second coil movable within said third and fourth magnetic fields in response to movement of said cantilever to cut perpendicularly the magnetic fluxes of said third and fourth magnetic fields to produce electrical signals in said second coil, said second coil being positioned in said third and fourth air gaps in such a manner that when said second coil is in a neutral position, substantially one half of said second coil is located within said third air gap and substantially the other half of said second coil is located within said fourth air gap; and in which said first and second coils are located on opposite sides of a vertical plane passing through a longitudinal axis of said cantilever and arranged at respective angles of 45 degrees with respect to said vertical plane, whereby said first coil has induced therein an electromotive force corresponding to the component of movement of said cantilever in a direction perpendicular to one of said groove walls, and said second coil has induced therein an electromotive force corresponding to the component of movement of said cantilever in a direction perpendicular to the other one of said groove walls.

26. A pickup cartridge according to claim 25, wherein said first and second coils are each of a flat spiral shape arranged in a plane perpendicular to the magnetic fluxes in said first and second magnetic fields and said third and fourth magnetic fields, respectively.

27. A pickup cartridge according to claim 25, wherein said magnetic field producing means further comprises two yoke members of magnetically permeable material which extend between the other ends of said first and second permanent magnets and between the other ends of said fifth and sixth permanent magnets, respectively, for producing a closed path for magnetic flux.

28. A pickup cartridge according to claim 25, wherein said stylus tip is secured to one end of said cantilever and said first and second coils are supported on an armature member secured to the other end of said cantilever; further comprising supporting means including a suspension means for holding said other end of said cantilever and a damper member made of an elastic material which is secured to said armature member, said armature member having a shape enabling a component of movement of said cantilever in a direction perpendicular to a horizontal surface of said record disk to be subjected by said damper member to a damping force having a magnitude greater than the magnitude of the damping force to which a component of movement of said cantilever in a direction parallel with the horizontal surface of said record disk is subjected.

29. A pickup cartridge according to claim 28, in which said armature member has an X-shaped configuration.

30. A pickup cartridge according to claim 28, in which said damper member has a surface recess matching the shape of said armature member, thereby allowing said armature member to be tightly fit therein.

31. A pickup cartridge according to claim 28, in which said first and second coils are supported on respective support plates made of silicon and attached to said armature member.

32. A pickup cartridge according to claim 31 in which each of said first and second coils is photo-etched on its respective support plate.

33. A pickup cartridge according to claim 31, in which each of said coil support plates is secured to a respective one of two projections of said armature member, said armature member being X-shaped and said projections extending at 45 degrees with respect to, and on opposite sides of, said vertical plane.

* * * * *